US011583907B2

(12) United States Patent
Hayase et al.

(10) Patent No.: US 11,583,907 B2
(45) Date of Patent: Feb. 21, 2023

(54) FORMING METHOD AND FORMING APPARATUS

(71) Applicant: KYB Corporation, Tokyo (JP)

(72) Inventors: Tomomi Hayase, Tokyo (JP); Ryuichi Kaneko, Tokyo (JP)

(73) Assignee: KYB CORPORATION, Tokyo (JP)

( * ) Notice: Subject to any disclaimer, the term of this patent is extended or adjusted under 35 U.S.C. 154(b) by 401 days.

(21) Appl. No.: 16/640,459

(22) PCT Filed: Aug. 22, 2018

(86) PCT No.: PCT/JP2018/030953
§ 371 (c)(1),
(2) Date: Feb. 20, 2020

(87) PCT Pub. No.: WO2019/039503
PCT Pub. Date: Feb. 28, 2019

(65) Prior Publication Data

US 2020/0188978 A1 Jun. 18, 2020

(30) Foreign Application Priority Data

Aug. 23, 2017 (JP) ..... JP2017-160244

(51) Int. Cl.
*B21C 37/29* (2006.01)
*B21D 28/28* (2006.01)

(52) U.S. Cl.
CPC ..... *B21C 37/29* (2013.01); *B21D 28/28* (2013.01)

(58) Field of Classification Search
CPC .... B21D 28/28; B21D 28/145; B21D 28/385; B21D 28/325; B21D 19/08; B21C 37/29; B21C 37/292
See application file for complete search history.

(56) References Cited

U.S. PATENT DOCUMENTS 1,911,653 A * 5/1933 Taylor ..... B21C 37/292 285/133.11
4,246,772 A * 1/1981 Moshnin ..... B21C 37/292 72/370.27

(Continued)

FOREIGN PATENT DOCUMENTS

CN 201841206 U 5/2011
CN 202779254 U 3/2013

(Continued)

OTHER PUBLICATIONS

International Search Report for PCT/JP2018/030953, dated Nov. 27, 2018 (4 pgs. with English translation).

(Continued)

*Primary Examiner* — Teresa M Ekiert
(74) *Attorney, Agent, or Firm* — Smith, Gambrell & Russell, LLP

(57) ABSTRACT

Provided are a forming method and a forming apparatus which can secure strength after forming while suppressing deformation.

The forming method of the present invention includes a burring step and a pressing step. In the burring step, a branch pipe is formed by causing a cylindrical peripheral wall of a cylindrical member (workpiece) having the peripheral wall to project in an outside direction in a tubular shape. In the pressing step, a distal end surface of the branch pipe is pressed toward a proximal end portion of the branch pipe. In the pressing step, the distal end surface of the branch pipe can be pressed by an end surface pressing punch in a state where a burring punch is inserted in the branch pipe.

4 Claims, 11 Drawing Sheets

(56) References Cited

U.S. PATENT DOCUMENTS

| | | | | |
|---|---|---|---|---|
| 5,140,881 | A * | 8/1992 | Aizaki | B21D 28/28 83/191 |
| 9,169,888 | B2 | 10/2015 | Nishimura et al. | |
| 2014/0048364 | A1 | 2/2014 | Nishimura et al. | |

FOREIGN PATENT DOCUMENTS

| | | | |
|---|---|---|---|
| CN | 205651060 | U | 10/2016 |
| FR | 1100159 | A | 9/1955 |
| GB | 759146 | A | 10/1956 |
| JP | 6-344039 | | 12/1994 |
| JP | H09-308919 | A | 12/1997 |
| JP | 2003-285121 | A | 10/2003 |
| JP | 2012-215224 | A | 11/2012 |
| JP | 2014-57997 | A | 4/2014 |

OTHER PUBLICATIONS

Written Opinion of the International Searching Authority for PCT/JP2018/030953, dated Nov. 27, 2018 (4pgs.).

Chinese Office Action dated Aug. 24, 2020 for Chinese Patent Application No. 201880036799.6 (7 pages in Chinese with English Translation).

Office Action for Japanese Patent Application No. 2017-160244 dated Sep. 15, 2020 (4 pages and English Translation).

Office Action for Japanese Patent Application No. 2017-160244 dated Dec. 28, 2020 (4 pages in Japanese with English Machine Translation).

* cited by examiner

FORMING METHOD AND FORMING APPARATUS

TECHNICAL FIELD

The present invention relates to a forming method and a forming apparatus.

BACKGROUND ART

Patent Literature 1 discloses a method of forming a branch pipe in a cylindrical member. In this forming method, the branch pipe is formed by causing a peripheral wall of the cylindrical member to project toward radially outside by burring processing. In the branch pipe thus formed, tensile residual stress due to the burring processing has been generated in the vicinity of its proximal end portion, so that strength thereof has been lowered. For this reason, in Patent Literature 1, the vicinity of the proximal end portion of the branch pipe is pressed; more specifically, both sides of the proximal end portion of the branch pipe in a circumferential direction of the peripheral wall of the cylindrical member are pressed from inside, so that a recessed portion in which the inner peripheral surface of the peripheral wall is dented is formed. According to this configuration, the tensile residual stress is reduced or changed into a compression direction, thereby improving the strength reduced after the burring processing.

CITATION LIST

Patent Literature

Patent Literature 1: JP 2014-57997 A

SUMMARY OF INVENTION

Technical Problems

However, in the case of Patent Literature 1, the appearance of the cylindrical member is not good due to the deformation caused, such as an outward bulge. In addition, when other members are to be assembled to the branch pipe or its vicinity, it is necessary to consider interference with the deformed portion in the assembly, which is complicated.

The present invention has been completed in view of the above-described conventional circumstances, and it is an object to be solved to provide a forming method and a forming apparatus which can secure strength after forming while suppressing deformation.

Solutions to Problems

A forming method according to the present invention includes a burring step and a pressing step. In the burring step, a branch pipe is formed by causing a cylindrical peripheral wall of a cylindrical member having the peripheral wall to project in an outside direction in a tubular shape. In the pressing step, a distal end surface of the branch pipe is pressed toward a proximal end portion of the branch pipe.

In the forming method of the present invention, in the burring step, the branch pipe may be formed by causing a burring punch to project from an inside to an outside of the peripheral wall of the cylindrical member. And, in the pressing step, the distal end surface of the branch pipe may be pressed by an end surface pressing punch in a state where the burring punch is inserted in the branch pipe.

In the forming method of the present invention, in the pressing step, at least a distal end surface of a peripheral wall of the branch pipe may be pressed.

Here, the branch pipe formed in the burring step of the present invention by causing the peripheral wall of the cylindrical member to project in the tubular shape may be opened penetrating through the peripheral wall of the cylindrical member, or may not be opened.

A forming apparatus according to the present invention includes a burring processing unit and a pressing unit. The burring processing unit forms a branch pipe in a direction orthogonal to a central axis of a cylindrical workpiece. The pressing unit presses a distal end surface of the branch pipe toward a proximal end side of the branch pipe. The burring processing unit includes a burring punch and a first drive means. The burring punch is disposed inside a cylindrical member having a cylindrical peripheral wall and is provided so as to be movable in a direction orthogonal to a central axis of the cylindrical member. The first drive means moves the burring punch toward the peripheral wall. The pressing unit includes an end surface pressing punch and a second drive means. The end surface pressing punch is disposed outside the cylindrical member and provided so as to be movable in the direction orthogonal to the central axis of the cylindrical member. The second drive means moves the end surface pressing punch toward the distal end surface of the branch pipe.

In the forming apparatus of the present invention, the end surface pressing punch may include a protrusion projecting from a pressing surface for pressing the distal end surface of the branch pipe. The protrusion is configured to be inserted into the branch pipe by a movement of the end surface pressing punch and thereby push back the burring punch.

In the forming apparatus of the present invention, in the end surface pressing punch, a pressing surface for pressing the distal end surface of the branch pipe is formed in an annular shape.

DESCRIPTION OF EMBODIMENTS

First to fourth embodiments in which a forming method and a forming apparatus according to the present invention are embodied will be described hereinafter with reference to the drawings.

Figure 1:
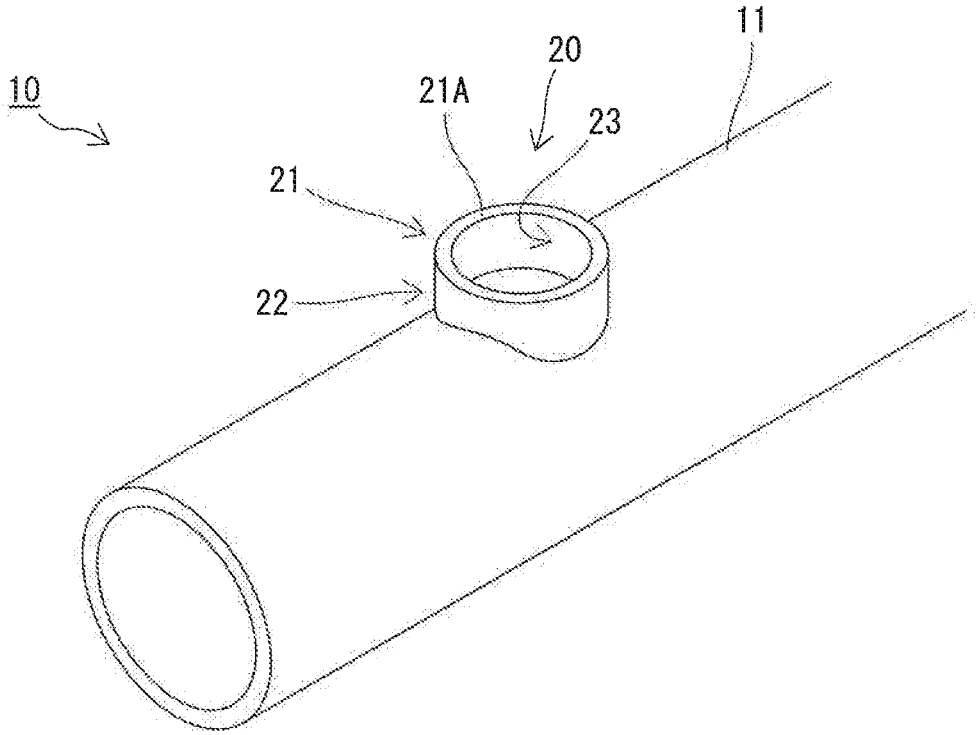
FIG. 1 is a perspective view illustrating an example of a cylindrical member having a branch pipe formed by a forming method according to first to fourth embodiments.
Figure 2:
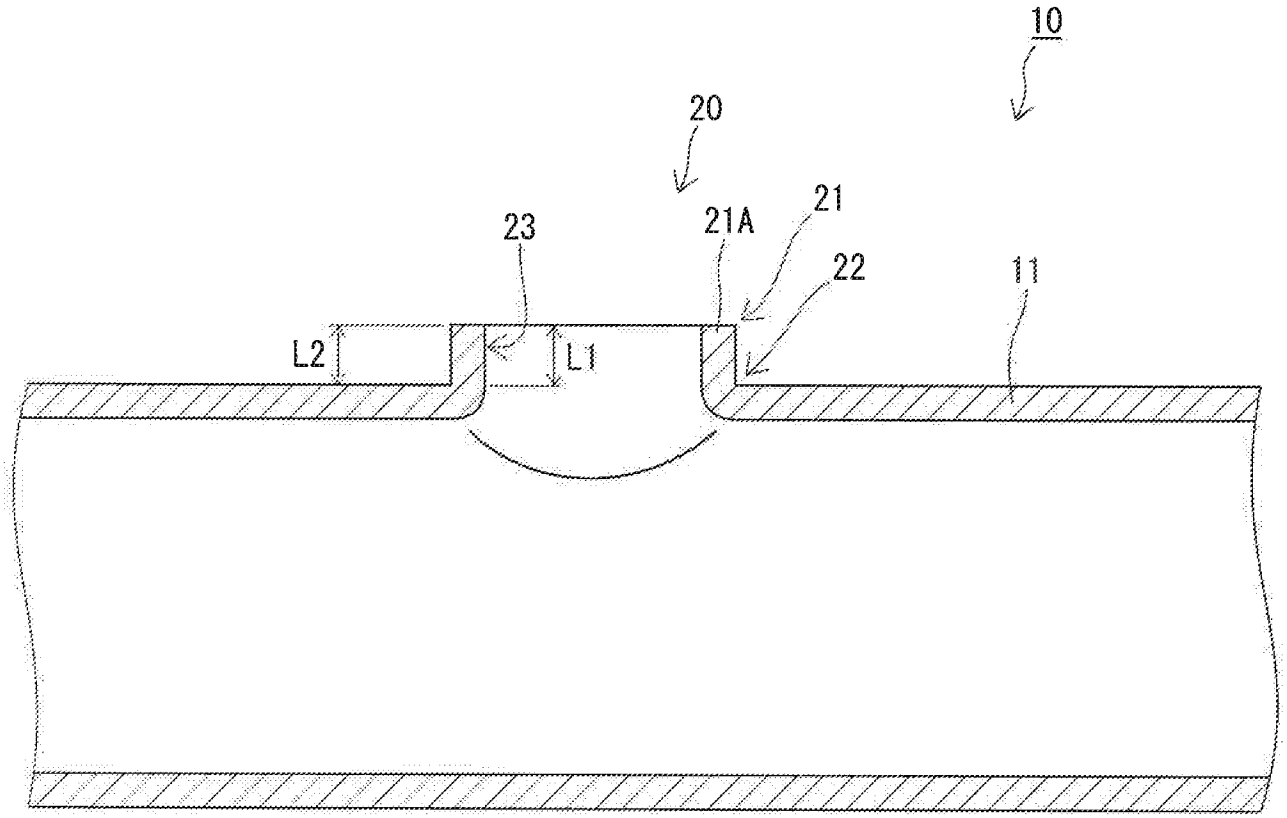
FIG. 2 is a cross-sectional view illustrating the example of the cylindrical member having the branch pipe formed by the forming method according to the first to fourth embodiments.

The forming method of the first to fourth embodiments is used when a branch pipe 20 is formed in a workpiece 10 as a cylindrical member according to the present invention, as shown in FIG. 1 and FIG. 2. The workpiece 10 is a metal straight pipe and has a cylindrical peripheral wall 11. The branch pipe 20 is formed by causing the peripheral wall 11 of the workpiece 10 to project in an outside direction in a tubular shape. The branch pipe 20 is formed to project in a direction orthogonal to a central axis of the workpiece 10. The branch pipe 20 is formed into the tubular shape in which a distal end portion 21 thereof is opened and a proximal end portion 22 thereof is connected to the peripheral wall 11. The branch pipe 20 is formed with a length L1 of a straight pipe portion 23 having a substantially constant inner diameter, and with a projection length L2 from the peripheral wall 11 of the workpiece 10.

When the workpiece 10 in which the branch pipe 20 has been formed is used as a product, a working fluid is enclosed in its inside. Another member is connected to the branch pipe 20 and the fluid is allowed to flow therethrough. An inner peripheral surface of the straight pipe portion 23 of the branch pipe 20 serves as a contact surface of a seal member that prevents a leakage of the working fluid from a connected portion.

First Embodiment

In the forming method according to the first embodiment, as shown in FIG. 3 to FIG. 7, a forming apparatus 1 is used as an apparatus for forming the workpiece 10. The forming apparatus 1 includes a clamp die unit 30, a burring processing unit 40, and a pressing unit 50.

The clamp die unit 30 has a first clamp die 31 and a second clamp die 32. The clamp die unit 30 clamps and holds the workpiece 10 by the first clamp die 31 and the second clamp die 32. Specifically, the first clamp die 31 and the second clamp die 32 are provided so as to be movable in directions of approaching and separating from each other by a drive mechanism not shown. The first clamp die 31 and the second clamp die 32 are formed with grooves 31A and 32A, respectively, each having a semicircular cross-section. Each of the grooves 31A, 32A is formed with a depth substantially equal to a radius of the workpiece 10. By combining the grooves 31A, 32A in a state of being opposite to each other, the first clamp die 31 and the second clamp die 32 form a space having a substantially circular cross-section. The workpiece 10 is inserted into this space and sandwiched therein, so that the clamp die unit 30 clamps the workpiece 10. The first clamp die 31 is formed with a through hole 31B. The through hole 31B has an inner diameter substantially equal to an outer diameter of the branch pipe 20 to be formed. In the first clamp die 31, the through hole 31B is formed extending in a direction opposite to an opening direction of the groove 31A and in the direction orthogonal to an extending direction of the groove 31A.

The burring processing unit 40 has a burring punch 41, a core bar 42, and a core bar guide 43. The burring punch 41 is formed in a columnar shape having an outer diameter equal to an inner diameter of the branch pipe 20 to be formed. The burring punch 41 is provided so as to be movable in an axial direction thereof. The core bar 42 is formed in a columnar shape and disposed such that its central axis is substantially orthogonal to a central axis of the burring punch 41. The core bar 42 is provided so as to be movable in an axial direction thereof by a drive means not shown such as a hydraulic cylinder. The core bar guide 43 is formed in a cylindrical shape having an outer diameter substantially equal to an inner diameter of the workpiece 10, and is fixed to a main body (not shown) side of the forming apparatus 1. The core bar 42 is coaxially disposed in the core bar guide 43, and moves in the axial direction along an inner peripheral surface of the core bar guide 43. That is, the core bar guide 43 guides the axial movement of the core bar 42. In a peripheral wall of the core bar guide 43, a guide hole 43A is formed which has an inner diameter substantially equal to the outer diameter of the burring punch 41. The burring punch 41 is inserted in the guide hole 43A. The burring punch 41 is slid on an inner peripheral surface of the guide hole 43A, and thus the guide hole 43A guides an axial movement of the burring punch 41. Further, the guide hole 43A prevents the burring punch 41 from moving to the moving direction of the core bar 42 along with the movement of the core bar 42.

In the present embodiment, it can be said that the first drive means according to the present invention is constituted by including the core bar 42, the drive means not shown for driving the core bar 42, and the core bar guide 43.

The operation of the burring processing unit 40 according to the present embodiment is as follows. The burring punch 41 has one axial end serving as a processing surface 41A which performs burring processing. The processing surface 41A is a plane orthogonal to the axial direction of the burring punch 41. The outer periphery of the processing surface 41A is formed with a chamfered portion 41B on which round chamfering has been performed, thereby connecting the processing surface 41A and the outer peripheral surface of the burring punch 41 smoothly.

The other end of the burring punch 41 is provided with a tapered surface 41C formed obliquely into a tapered shape. A distal end surface 42A of the core bar 42 is also formed obliquely into a tapered shape. The tapered surface 41C of the burring punch 41 and the distal end surface 42A of the core bar 42 are slidably in contact with each other. The core bar 42 is slid and moved in the core bar guide 43 in the axial direction by the drive means not shown provided on the main body side of the forming apparatus 1. When the core bar 42 moves in the axial direction, the distal end surface 42A of the core bar 42 abuts against the tapered surface 41C of the burring punch 41. Then, the tapered surface 41C and the distal end surface 42A of the core bar 42 are slid on each other by the movement of the core bar 42, which applies to the burring punch 41 an urging force in a direction intersecting the moving direction of the core bar 42.

The burring punch 41 to which the urging force has been applied is guided by the inner peripheral surface of the guide hole 43A of the core bar guide 43, and moves in the direction orthogonal to the moving direction of the core bar 42. Thus, the burring punch 41 is urged by the core bar 42 from the tapered surface 41C side, whereby the burring punch 41 moves in the axial direction thereof that is the direction orthogonal to the moving direction of the core bar 42, along the inner peripheral surface of the guide hole 43A of the core bar guide 43.

The pressing unit 50 has an end surface pressing punch 51. The end surface pressing punch 51 is formed in a columnar shape having an outer diameter substantially equal to the outer diameter of the branch pipe 20. A pressing surface 51A is provided on an axial end surface of the end surface pressing punch 51. The end surface pressing punch 51 is coaxially disposed on the central axis of the burring punch 41 in such a manner that the pressing surface 51A is opposite to the processing surface 41A of the burring punch 41. The end surface pressing punch 51 is provided so as to be movable in its axial direction by a drive means not shown such as a hydraulic cylinder (exemplified as a second drive means according to the present invention).

The forming method of forming the branch pipe 20 in the workpiece 10 using the forming apparatus 1 having the above-described configuration will be described hereinafter.

Figure 3:
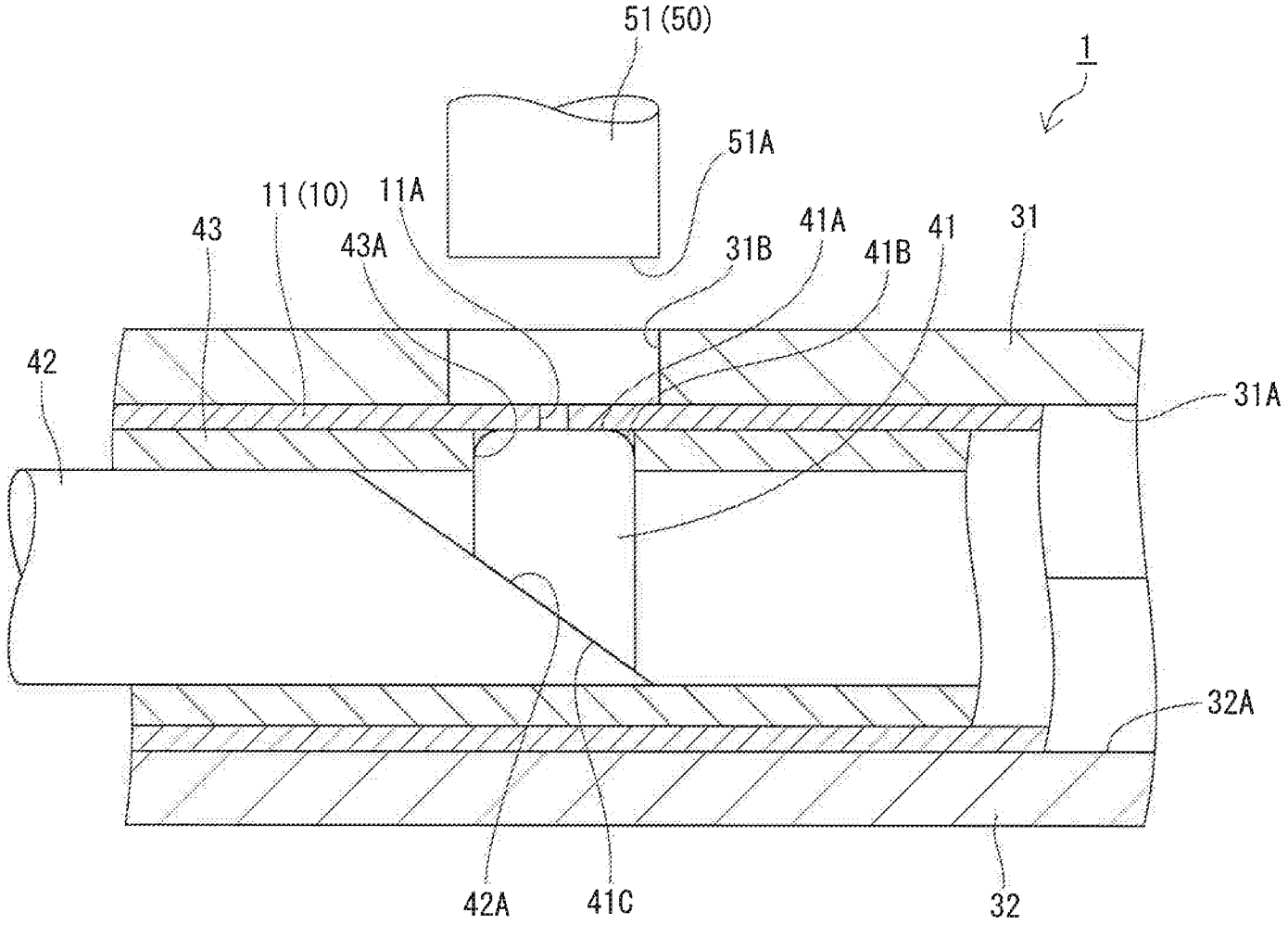
FIG. 3 is a diagram (part 1) for describing the forming method according to the first embodiment.

When the branch pipe 20 is formed in the workpiece 10, at first, as shown in FIG. 3, an outer peripheral surface of the peripheral wall 11 of the workpiece 10 is clamped by the clamp die unit 30, and the burring processing unit 40 is inserted into the workpiece 10. Either one of these operations may be performed first, or both of them may be performed simultaneously.

Figure 4:
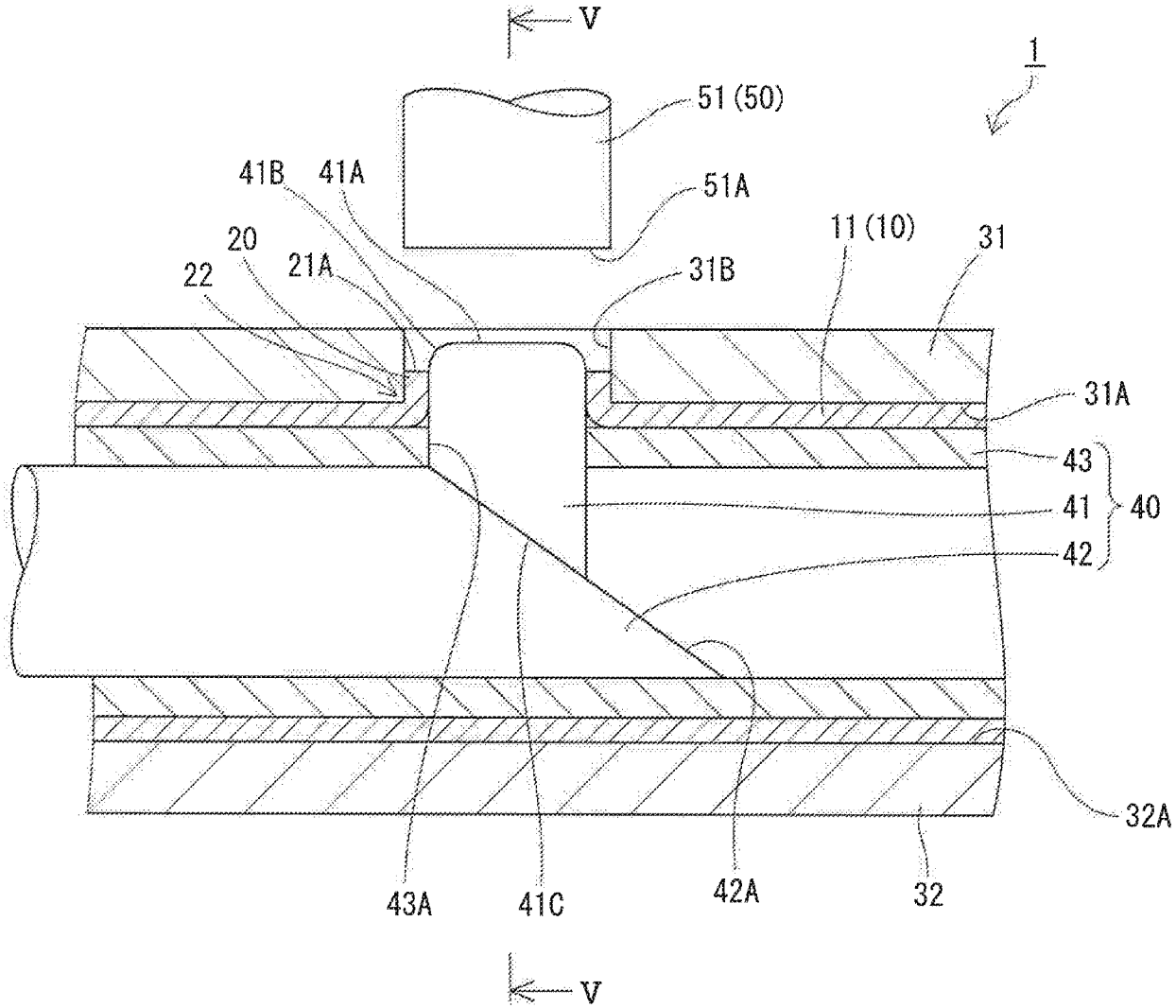
FIG. 4 is a diagram (part 2) for describing the forming method according to the first embodiment.
Figure 5:
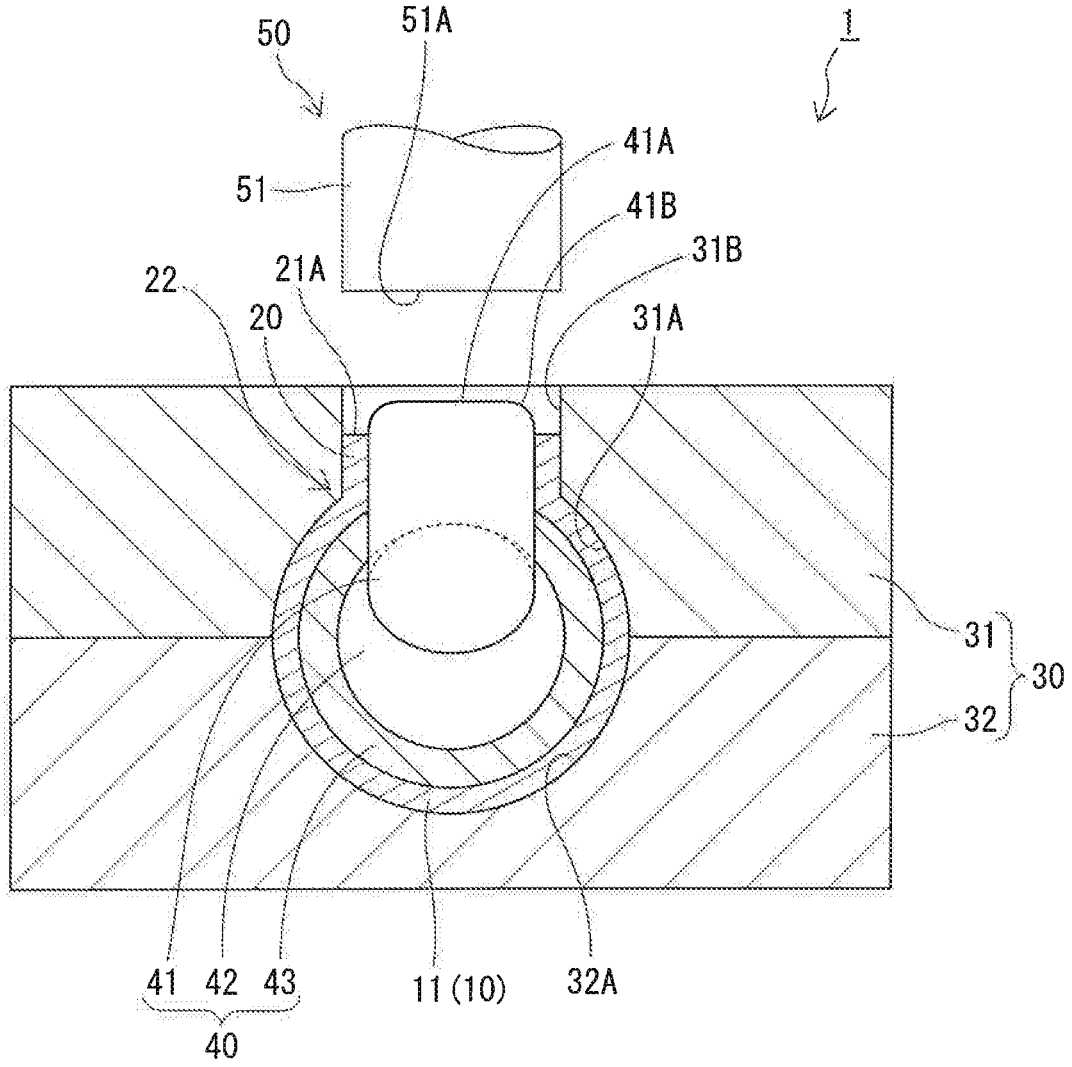
FIG. 5 is a cross-sectional view taken along a line V-V of FIG. 4.

Then, the branch pipe 20 is formed by causing the peripheral wall 11 of the workpiece 10 to project in the outside direction in the tubular shape (burring step). Specifically, in a case of the present embodiment, as shown in FIG. 4 and FIG. 5, the burring punch 41 is caused to penetrate from an inside to an outside of the peripheral wall 11 of the workpiece 10. That is, the core bar 42 is moved along the inner peripheral surface of the core bar guide 43 to apply to the burring punch 41 the urging force in the outside direction of the peripheral wall 11, so that the burring punch 41 is caused to penetrate from the inside to the outside of the peripheral wall 11. The peripheral wall 11 through which the burring punch 41 penetrates is restricted by an inner peripheral surface of the through hole 31B of the first clamp die 31 and the outer peripheral surface of the burring punch 41, so that the branch pipe 20 is formed with the outer diameter according to the inner peripheral surface of the through hole 31B and with the inner diameter according to the outer peripheral surface of the burring punch 41. At this time, residual stress in a tensile direction due to the burring processing is generated in the vicinity of the proximal end portion 22 of the branch pipe 20.

Figure 6:
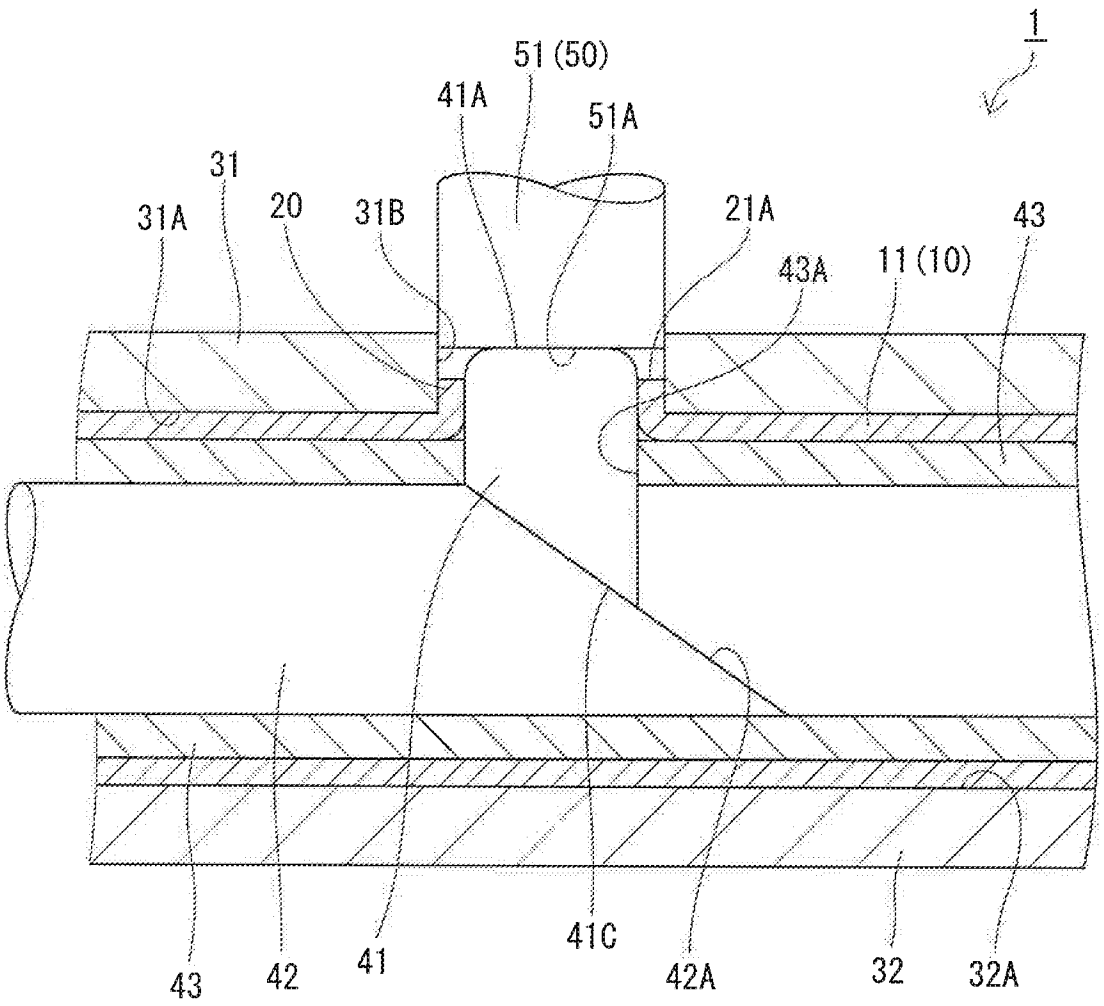
FIG. 6 is a diagram (part 3) for describing the forming method according to the first embodiment.

In the burring step of the present embodiment, when the branch pipe 20 has been formed, the burring punch 41 is in a state where a distal end portion thereof projects from the distal end surface 21A of the branch pipe 20, as shown in FIG. 6.

A pilot hole 11A has been formed in the burring processing portion of the peripheral wall 11 in advance before the burring processing. The pilot hole 11A may be formed before the workpiece 10 is set in the forming apparatus 1, or may be formed after the workpiece 10 has been set in the forming apparatus 1. In a case where the pilot hole 11A has been formed in advance before the workpiece 10 is set in the forming apparatus 1, the burring processing unit 40 is inserted into the workpiece 10 such that the pilot hole 11A is arranged at a position conforming to a center of the burring punch 41.

Figure 7:
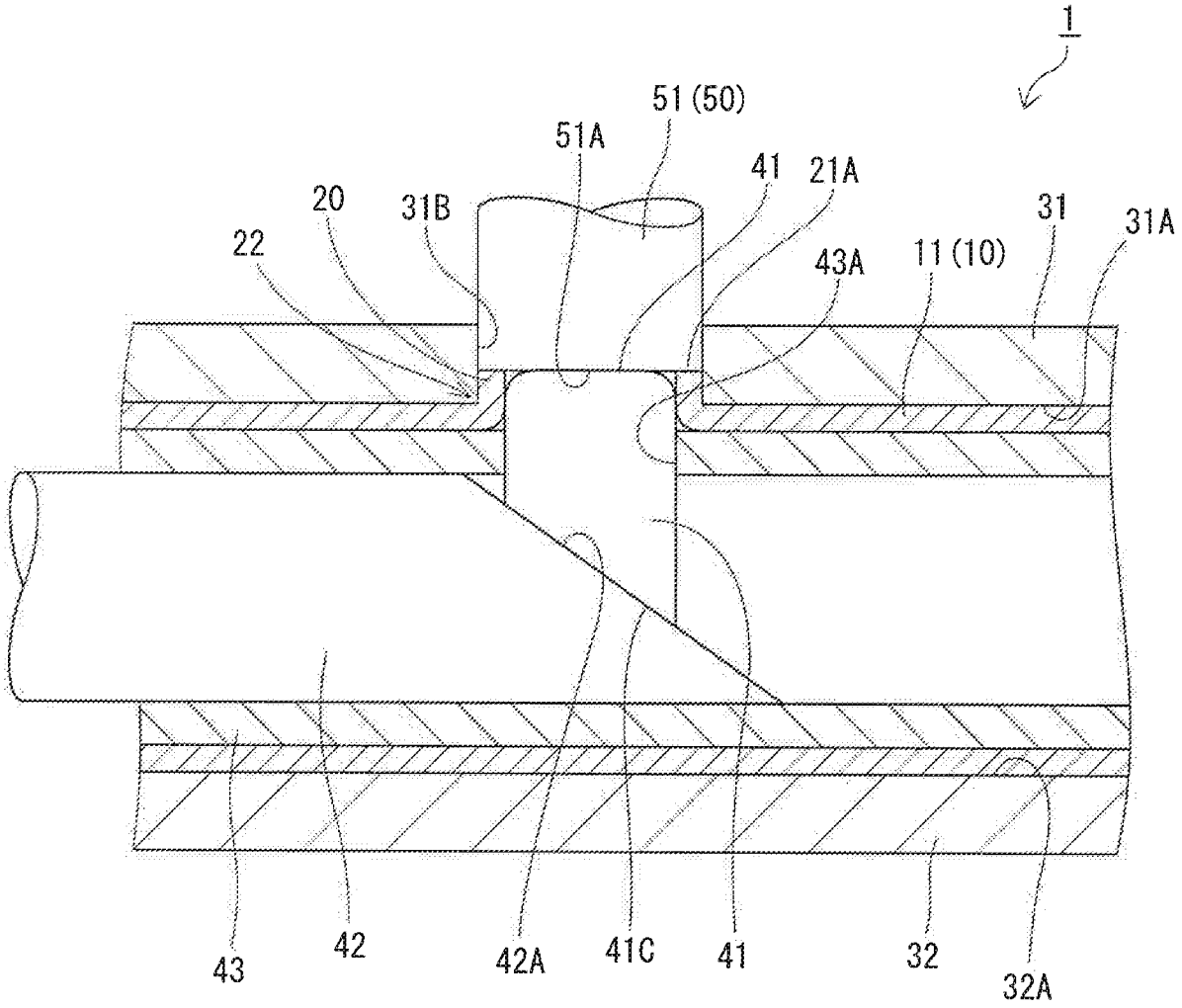
FIG. 7 is a diagram (part 4) for describing the forming method according to the first embodiment.

Subsequently, the distal end surface 21A of the branch pipe 20 is pressed toward the proximal end portion 22 of the branch pipe 20 (pressing step). In the case of the present embodiment, as shown in FIG. 7, the branch pipe 20 is pressed by the end surface pressing punch 51. Specifically, the end surface pressing punch 51 is moved toward the burring punch 41, and the distal end surface 21A of the branch pipe 20 is pressed by the pressing surface 51A. Thereby, the residual stress in the tensile direction generated in the vicinity of the proximal end portion 22 of the branch pipe 20 is reduced or changed into stress in a compression direction. Thus, in the present embodiment, the pressing step is performed continuously with the burring step.

As described above, when the burring step is performed, the burring punch 41 is in a state of projecting from the distal end surface 21A of the branch pipe 20. In the case of the present embodiment, the pressing step is performed while the pressing surface 51A of the end surface pressing punch 51 presses the processing surface 41A of the burring punch 41 to push back the burring punch 41. That is, the pressing step according to the present embodiment is performed in a state where the burring punch 41 is inserted in the branch pipe 20. As a result, radial deformation of the branch pipe 20 is suppressed. In the pressing step, the distal end surface 21A is pressed such that the branch pipe 20 is slightly contracted toward the proximal end portion 22 side. At this time, since the distal end surface 21A is pressed in a state of being blocked by the clamp die unit 30, the burring punch 41, and the core bar guide 43, deformation of an outer shape of the branch pipe 20 is suppressed, and pressure appropriately acts to reduce the residual stress in the tensile direction or change it into the stress in the compression direction.

As described above, the forming method according to the first embodiment includes the burring step and the pressing step. In the burring step, the branch pipe 20 is formed by causing the peripheral wall 11 of the workpiece 10 having the cylindrical peripheral wall 11 to project in the outside direction in the tubular shape. In the pressing step, the distal end surface 21A of the branch pipe 20 is pressed toward the proximal end portion 22 of the branch pipe 20.

As described above, by pressing the distal end surface 21A of the branch pipe 20 toward the proximal end portion 22 in the pressing step, the residual stress in the tensile direction in the vicinity of the proximal end portion 22 of the branch pipe 20 generated in the peripheral wall 11 of the workpiece 10 in the burring step is reduced or changed into the stress in the compression direction. Since the distal end surface 21A of the branch pipe 20 is pressed toward the proximal end portion 22, the deformation in the outside direction due to the pressing is less likely to be caused in the vicinity of the proximal end portion 22 of the branch pipe 20.

Therefore, the forming method of the first embodiment can secure the strength of the peripheral wall 11 of the workpiece 10 in the proximal end portion 22 of the branch pipe 20 after forming while suppressing the deformation of the peripheral wall 11 of the workpiece 10 in the vicinity of the proximal end portion 22 of the branch pipe 20.

Further, according to the forming method of the first embodiment, in the burring step, the branch pipe 20 is formed by causing the burring punch 41 to penetrate from the inside to the outside of the peripheral wall 11 of the workpiece 10, and in the pressing step, the distal end surface 21A of the branch pipe 20 is pressed by the end surface pressing punch 51 in the state where the burring punch 41 is inserted in the branch pipe 20. Therefore, in the pressing step, the deformation of the branch pipe 20 toward the radially inside is suppressed by the burring punch 41, so that dimensional accuracy of the branch pipe 20 in the radial direction can be secured.

Further, according to the forming method of the first embodiment, as shown in FIG. 2, the branch pipe 20 in which the projection length L2 from the peripheral wall 11 is suppressed can be formed while securing the length L1 of the straight pipe portion 23. For example, in a case where the vicinity of the proximal end portion of the branch pipe is deformed outward into a convex shape as in a conventional method, the projection length of the branch pipe is rendered longer since a length of a portion deformed outward into the convex shape is included in the projection length of the branch pipe in addition to the length of the straight pipe portion. However, according to the forming method of the first embodiment, since the deformation in the outside direction due to the pressing is less likely to be caused, the projection length L2 from the peripheral wall 11 can be suppressed while securing the length L1 of the straight pipe portion 23 as compared with the conventional method, so that space saving can be achieved.

Further, the forming apparatus 1 of the first embodiment includes the burring processing unit 40 and the pressing unit 50. The burring processing unit 40 forms the branch pipe 20 in the direction orthogonal to the central axis of the workpiece 10. The pressing unit 50 presses the distal end surface of the branch pipe 20 toward the proximal end side of the branch pipe 20. The burring processing unit 40 includes the burring punch 41 and, as the first drive means, the core bar 42, the drive means not shown, and the core bar guide 43. The burring punch 41 is disposed inside the workpiece 10 having the cylindrical peripheral wall 11 and is provided so as to be movable in the direction orthogonal to the central axis of the workpiece 10. The core bar 42, the drive means not shown, and the core bar guide 43, those serving as the first drive means, move the burring punch 41 toward the peripheral wall 11 of the workpiece 10. The pressing unit 50 includes the end surface pressing punch 51 and the drive means not shown as the second drive means. The end surface pressing punch 51 is disposed outside the workpiece 10 and provided so as to be movable in the direction orthogonal to the central axis of the workpiece 10. The end surface pressing punch 51 is moved toward the peripheral wall 11 of the workpiece 10 by the drive means not shown as the second drive means, and thereby presses the distal end surface 21A of the branch pipe 20.

In the forming apparatus 1, the distal end surface 21A of the branch pipe 20 formed by the burring processing unit 40 is pressed by the end surface pressing punch 51 of the pressing unit 50. As a result, the residual stress in the tensile direction in the vicinity of the proximal end portion 22 of the branch pipe 20 generated by the burring step can be reduced or changed into the stress in the compression direction. Further, since the end surface pressing punch 51 presses the distal end surface 21A of the branch pipe 20, the deformation in the outside direction due to the pressing is less likely to be caused in the vicinity of the proximal end portion 22 of the branch pipe 20.

Therefore, the forming apparatus 1 can secure the strength a after forming while suppressing the deformation.

Second Embodiment

Figure 8:
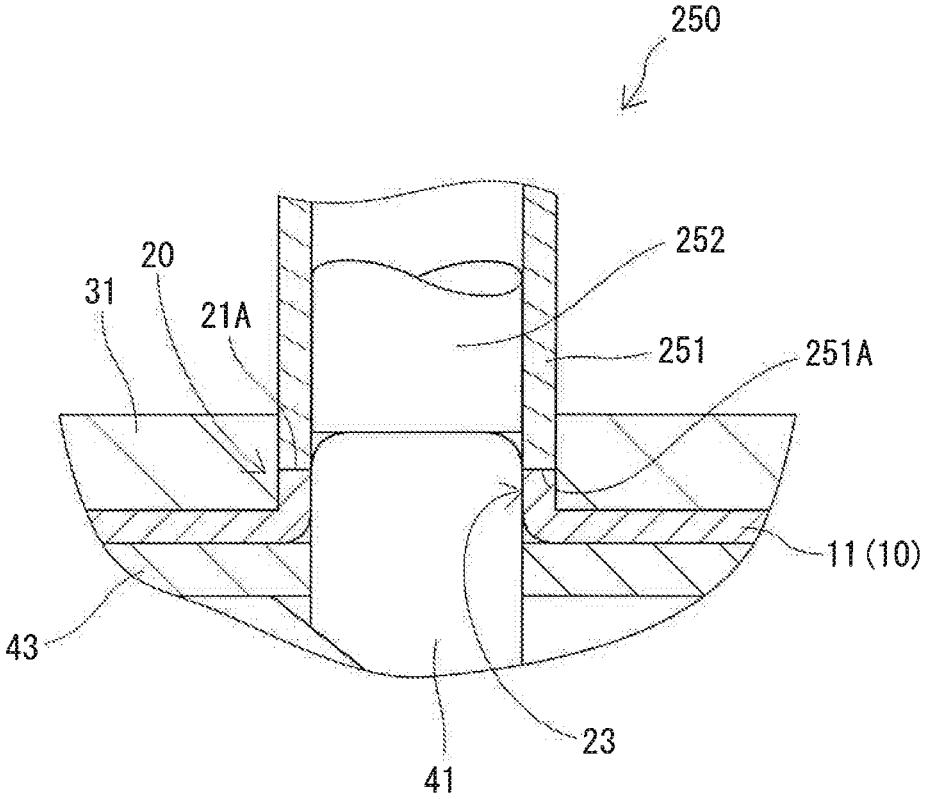
FIG. 8 is a diagram for describing the forming method according to the second embodiment.

The second embodiment will be described hereinafter with reference to FIG. 8 and so on.

A forming method of the second embodiment is different from the forming method of the first embodiment in a pressing form of the distal end surface 21A of the branch pipe 20. In the present embodiment, a pressing unit 250 includes an end surface pressing punch 251 that is formed in a cylindrical shape having substantially the same inner and outer diameters as the branch pipe 20. The end surface pressing punch 251 has a pressing surface 251A for pressing the distal end surface 21A of the branch pipe 20, that is formed in an annular shape. According to this configuration, the end surface pressing punch 251 is capable of pressing only the distal end surface 21A of the branch pipe 20 without pushing back the burring punch 41. The pressing unit 250 includes a columnar push-back punch 252 disposed in the end surface pressing punch 251 to be coaxial with the end surface pressing punch 251. The push-back punch 252 is provided so as to be slidable in the axial direction separately from the end surface pressing punch 251.

Such a forming method and a forming apparatus also exhibit the same effects as the forming method and the forming apparatus of the first embodiment. In addition, since only the distal end surface 21A of the branch pipe 20 is pressed separately from pushing back of the burring punch 41, the pressing step can be performed in a state where the burring punch 41 is reliably inserted in the branch pipe 20, with the result that the radial deformation of the branch pipe 20 can be more reliably suppressed. Further, the push-back punch 252 is provided to be slidable in the axial direction separately from the end surface pressing punch 251. Therefore, in the pressing step, the chamfered portion 41B of the burring punch 41 projecting from the distal end surface 21A of the branch pipe 20 can be retracted by providing a space inside the end surface pressing punch 251 with a depth substantially equal to an axial length of the chamfered portion 41B of the burring punch 41. As a result, the pressing step can be performed in a state where the outer peripheral surface of the burring punch 41 in its proximal end side than the chamfered portion 41B (that is, the outer peripheral surface without being round chamfered) is in contact with the inner peripheral surface of the branch pipe 20. That is, the pressing step can be performed in a state where no space is provided between the inner peripheral surface of the branch pipe 20 and the outer peripheral surface of the burring punch 41. Therefore, the radial deformation of the branch pipe 20 can be more reliably suppressed. In addition, the burring punch 41 can be reliably pushed back by the push-back punch 252.

Further, in the second embodiment, the pressing surface 251A of the end surface pressing punch 251 is formed in an annular shape, in the pressing step, the distal end surface 21A of the branch pipe 20 is pressed toward the proximal end portion 22 by the annular pressing surface 251A. According to this configuration, in the distal end surface 21A of the branch pipe 20, a distal end of the straight pipe portion 23 which is equivalent to a distal end surface of the peripheral wall of the branch pipe 20 is pressed in the axial direction in the pressing step. As a result, the pressing force by the end surface pressing punch 251 can be appropriately transmitted from the distal end surface 21A of the branch pipe 20 to the proximal end portion 22 side.

Third Embodiment

Figure 9:
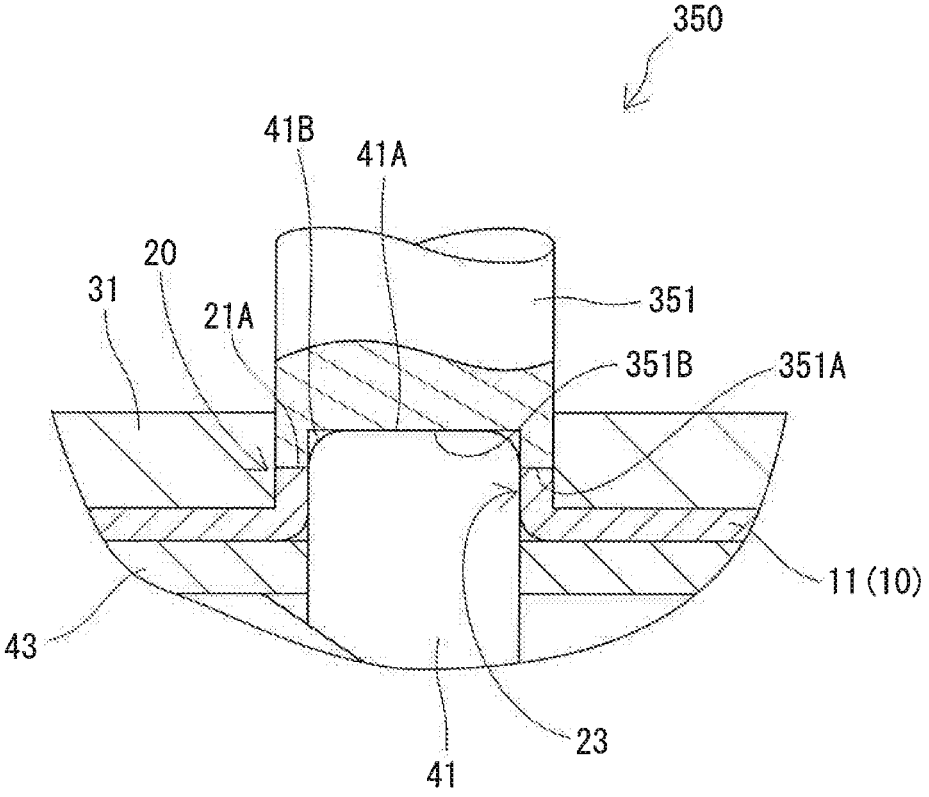
FIG. 9 is a diagram for describing the forming method according to the third embodiment.

The third embodiment will be described hereinafter with reference to FIG. 9 and so on.

A forming method and a forming apparatus of the third embodiment are different from the forming method and the forming apparatus of the first embodiment in a pressing form of the distal end surface 21A of the branch pipe 20. In the present embodiment, a pressing unit 350 includes an end surface pressing punch 351 formed into a columnar shape having the same diameter as the outer diameter of the branch pipe 20. A pressing surface 351A of the end surface pressing punch 351 is formed in an annular shape as in the second embodiment. Specifically, the pressing surface 351A of the end surface pressing punch 351 is formed with a recess 351B having an inner diameter substantially equal to the inner diameter of the branch pipe 20, that is, the outer diameter of the burring punch 41. The recess 351B has a depth substantially equal to the axial length of the chamfered portion 41B formed on the outer periphery of the processing surface 41A of the burring punch 41. Accordingly, before pushing back the burring punch 41, the end surface pressing punch 351 can press the distal end surface 21A of the branch pipe 20 in a state where the burring punch 41 is inserted therein. After the distal end surface 21A of the branch pipe 20 has been pressed, a bottom surface of the recess 3518 is made into contact with the processing surface 41A of the burring punch 41, and thereby the burring punch 41 can be pushed back.

Such a forming method and a forming apparatus also exhibit the same effects as the forming method and the forming apparatus of the first embodiment. In addition, since only the distal end surface 21A of the branch pipe 20 can be pressed before the burring punch 41 is pushed back, the pressing step can be performed in a state where the burring punch 41 is reliably inserted in the branch pipe 20, with the result that the radial deformation of the branch pipe 20 can be more reliably suppressed. Further, since the recess 351B has the depth substantially equal to the axial length of the chamfered portion 41B of the burring punch 41, the chamfered portion 41B of the burring punch 41 projecting from the distal end surface 21A of the branch pipe 20 can be retracted in the pressing step. As a result, the pressing step can be performed in a state where the outer peripheral surface of the burring punch 41 in its proximal end side than the chamfered portion 41B (that is, the outer peripheral surface without being round chamfered) is in contact with the inner peripheral surface of the branch pipe 20. That is, the pressing step can be performed in a state where no space is provided between the inner peripheral surface of the branch pipe 20 and the outer peripheral surface of the burring punch 41. Therefore, the radial deformation of the branch pipe 20 can be more reliably suppressed. Further, the burring punch 41 can be pushed back continuously after the distal end surface 21A of the branch pipe 20 has been pressed, so that a simple forming method can be achieved.

Further, in the third embodiment, the distal end surface 21A of the branch pipe 20 is pressed toward the proximal end portion 22 by the pressing surface 351A formed into the annular shape as in the second embodiment. According to this configuration, in the distal end surface 21A of the branch pipe 20, a distal end of the straight pipe portion 23 which is equivalent to a distal end surface of the peripheral wall of the branch pipe 20 is pressed in the axial direction in the pressing step. As a result, the pressing force by the end surface pressing punch 351 can be appropriately transmitted from the distal end surface 21A of the branch pipe 20 to the proximal end portion 22 side.

Fourth Embodiment

Figure 10:
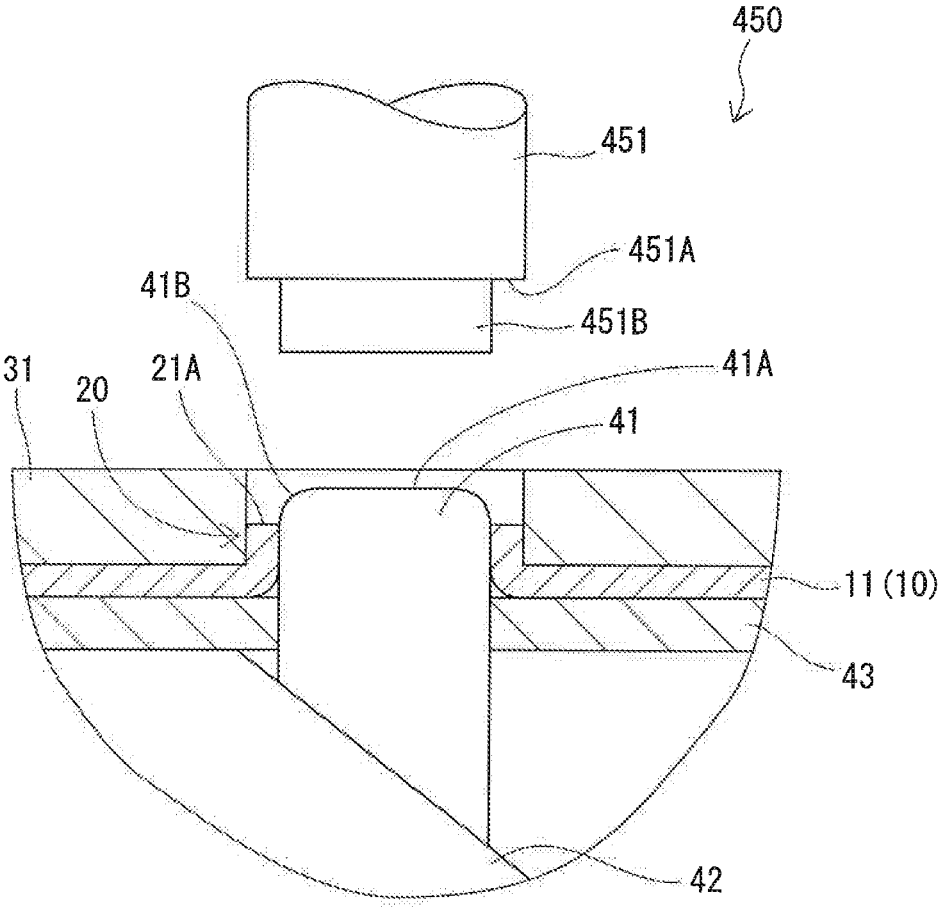
FIG. 10 is a diagram (part 1) for describing the forming method according to the fourth embodiment.
Figure 11:
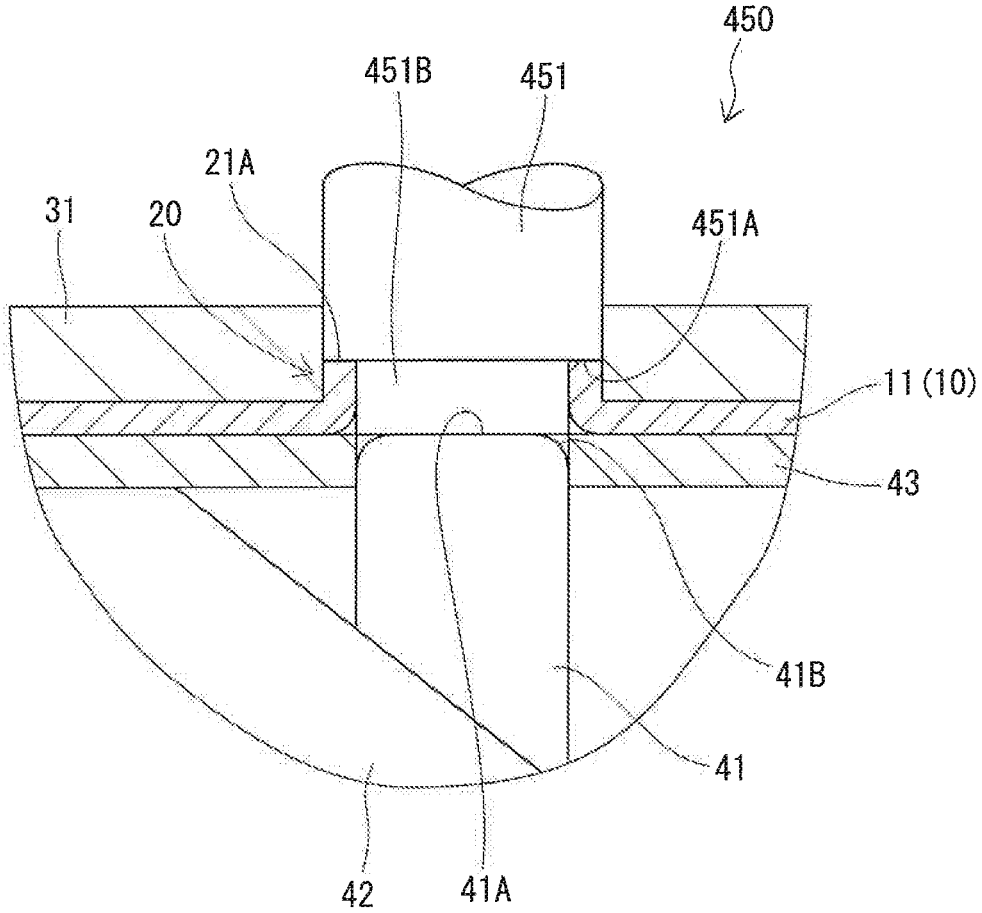
FIG. 11 is a diagram (part 2) for describing the forming method according to the fourth embodiment.

The fourth embodiment will be described hereinafter with reference to FIG. 10, FIG. 11, and so on.

A forming method and a forming apparatus of the fourth embodiment are different from the forming method of the first embodiment in a pressing form of the distal end surface 21A of the branch pipe 20. In the present embodiment, the pressing unit 450 includes an end surface pressing punch 451 formed into a columnar shape having substantially the same diameter as the outer diameter of the branch pipe 20. A pressing surface 451A of the end surface pressing punch 451 is formed with a protrusion 451B having an outer diameter substantially equal to the inner diameter of the branch pipe 20, that is, the outer diameter of the burring punch 41. The protrusion 451B is formed projecting sufficiently longer than the length L1 of the straight pipe portion 23 of the branch pipe 20 to be formed. According to this configuration, the end surface pressing punch 451 first pushes back the burring punch 41 by the protrusion 451B, and thereafter, presses the distal end surface 21A of the branch pipe 20 in a state where the protrusion 451B is inserted therein.

That is, in the forming method of the present embodiment, the branch pipe 20 is formed by causing the burring punch 41 to penetrate from the inside to the outside of the peripheral wall 11 of the workpiece 10 as the cylindrical member (burring step), and thereafter, by use of the end surface pressing punch 451 having the pressing surface 451A and the protrusion 451B projecting from the pressing surface 451A, the burring punch 41 is pushed back by the protrusion 451B and the distal end surface 21A of the branch pipe 20 in the state where the protrusion 451B is inserted in the branch pipe 20 is pressed by the pressing surface 451A (pressing step).

Such a forming method and a forming apparatus also exhibit the same effects as the forming method and the forming apparatus of the first embodiment. In addition, since the distal end surface 21A of the branch pipe 20 is pressed in the state where the protrusion 451B is inserted in the branch pipe 20 after the burring punch 41 has been pushed back by the protrusion 451B, the radial deformation of the branch pipe 20 can be more reliably suppressed. The burring punch 41 can be reliably pushed back by the protrusion 451B as in the second embodiment. Further, since the protrusion 451B is formed on the pressing surface 451A of the end surface pressing punch 451, reliable pushing back of the burring punch 41 can be realized with a simpler configuration than that of the second embodiment. Further, the distal end surface 21A of the branch pipe 20 can be pressed continuously after the burring punch 41 has been pushed back, so that a simple forming method can be achieved.

In the forming apparatus of the fourth embodiment, the end surface pressing punch 451 includes the protrusion 451B which is provided projecting from the pressing surface 451A for pressing the distal end surface 21A of the branch pipe 20 and configured to be inserted into the branch pipe 20 by the movement of the end surface pressing punch 451 and thereby pushes back the burring punch 41. According to this configuration, pushing hack of the burring punch 41 also can be performed by the movement of the end surface pressing punch 451 for pressing the distal end surface 21A of the branch pipe 20. As a result, reliable pushing back of the burring punch can be realized by the apparatus with a simple configuration.

The present invention is not limited to the embodiments described above with reference to the drawings. For example, the following embodiments are also included in the technical scope of the present invention.

(1) Although in the first to fourth embodiments, the forming method using the forming apparatus having the specific configuration is exemplified, the forming method of the present invention is not limited to the use of the forming apparatus having the configuration exemplified in the embodiments.

(2) Although in the first to fourth embodiments, the pilot hole is formed in the peripheral wall of the workpiece that is a cylindrical member before the burring step, this is not essential.

(3) In the first to fourth embodiments, when the workpiece as a cylindrical member is used as a product, the working fluid is enclosed therein. However, use of the cylindrical member in which the branch pipe is formed by the forming method of the present invention is not particularly limited.

(4) Although in the first to fourth embodiments, the pressing step is performed continuously with the burring step, the burring step and the pressing step may be separately performed. For example, after the burring step only is performed, the pressing step may be performed using another apparatus.

(5) Although in the second embodiment, the pressing unit includes the push-back punch for pushing back the burring punch, this is not essential.

(6) In the first to third embodiments, the pressing step is performed in the state where the burring punch is inserted in the branch pipe, and in the fourth embodiment, the pressing step is performed in the state where the protrusion is inserted in the branch pipe. However, these are not essential.

(7) Although in the first to fourth embodiments, the processing surface of the burring punch is a plane orthogonal to the axial direction of the burring punch, it may be a curved surface which projects in a dome shape in the axial direction having an arc-shaped cross section, a parabolic cross section and the like.

(8) Although in the first to fourth embodiments, the branch pipe is formed penetrating through the peripheral wall of the workpiece as the cylindrical member, the branch pipe may not penetrate therethrough but only project therefrom. In this case, it is preferable to use an end surface pressing punch having a pressing surface formed in an annular shape, since a central portion of the distal end surface of the branch pipe is not pressed but only a distal end surface of the peripheral wall of the branch pipe is pressed in the pressing step.

REFERENCE SIGNS LIST

1 forming apparatus
10 workpiece (cylindrical member)
11 peripheral wall
11A pilot hole
20 branch pipe
21 distal end portion
21A distal end surface
22 proximal end portion
23 straight pipe portion
30 clamp die unit
31 first clamp die
31A groove of first clamp die
31B through hole
32 second clamp die
32A groove of second clamp die
40 burring processing unit
41 burring punch
41A processing surface
41B chamfered portion
41C tapered surface
42 core bar
42A distal end surface
43 core bar guide
43A guide hole
50, 250, 350, 450 pressing unit
51, 251, 351, 451 end surface pressing punch
51A, 251A, 351A, 451A pressing surface
252 push-back punch
351B recess
451B protrusion
L1 length of straight pipe portion
L2 projection length from peripheral wall of branch pipe

The invention claimed is:

1. A forming method, comprising:

a burring step of forming a branch pipe by causing a cylindrical peripheral wall of a cylindrical member having the peripheral wall to project in an outside direction in a tubular shape; and a pressing step of pressing a distal end surface of the branch pipe toward a proximal end portion of the branch pipe, wherein in the burring step, the branch pipe including a straight pipe portion having a substantially constant inner diameter is formed by causing a burring punch in a columnar shape to project from an inside to an outside of the peripheral wall, and in the pressing step, using an end surface pressing punch that includes a pressing surface that presses the distal end surface of the branch pipe and a protrusion having a same outer diameter as an outer diameter of the burring punch and projecting from the pressing surface, the distal end surface of the branch pipe is pressed by the pressing surface in a state where the protrusion is inserted in the branch pipe.

2. The forming method according to claim 1, wherein in the pressing step, at least a distal end surface of a peripheral wall of the branch pipe is pressed.

3. A forming apparatus, comprising:

a burring processing unit for forming a branch pipe in a direction orthogonal to a central axis of a cylindrical member having a cylindrical peripheral wall, the branch pipe including a straight pipe portion having a substantially constant inner diameter; and a pressing unit for pressing a distal end surface of the branch pipe toward a proximal end side of the branch pipe, wherein the burring processing unit includes:

a burring punch that is disposed inside the cylindrical member and is provided so as to be movable in a direction orthogonal to a central axis of the cylindrical member, the burring punch being columnar and having an outer diameter that is equal to an inner diameter of the branch pipe; and a first drive means for moving the burring punch toward the peripheral wall, and the pressing unit includes:

an end surface pressing punch disposed outside the cylindrical member and provided so as to be movable in the direction orthogonal to the central axis of the cylindrical member; and a second drive means for moving the end surface pressing punch toward the distal end surface of the branch pipe, the end surface pressing punch includes a pressing surface that presses the distal end surface of the branch pipe and a protrusion having a same outer diameter as the outer diameter of the burring punch and projecting from the pressing surface, the protrusion being configured to be inserted into the branch pipe by a movement of the end surface pressing punch and thereby push back the burring punch, and the end surface pressing punch presses the distal end surface of the branch pipe by the pressing surface in a state where the protrusion is inserted in the branch pipe.

4. The forming apparatus according to claim 3, wherein in the end surface pressing punch, the pressing surface for pressing the distal end surface of the branch pipe is formed in an annular shape.

* * * * *